United States Patent [19]

Barall

[11] Patent Number: 4,545,507

[45] Date of Patent: Oct. 8, 1985

[54] METERING PUMP

[75] Inventor: Heinz Barall, Don Mills, Canada

[73] Assignee: Hibar Systems Ltd., Thornhill, Canada

[21] Appl. No.: 422,413

[22] Filed: Sep. 23, 1982

[30] Foreign Application Priority Data

Jun. 4, 1982 [CA] Canada ..... 404504

[51] Int. Cl.[4] ..... B67D 5/46

[52] U.S. Cl. ..... 222/137; 222/173; 222/255; 222/334

[58] Field of Search ..... 222/137, 173, 255, 309, 222/333–335, 380, 383

[56] References Cited

U.S. PATENT DOCUMENTS

| | | | |
|---|---|---|---|
| 2,510,317 | 6/1950 | Perkins | 222/255 |
| 2,850,051 | 9/1958 | Rasmusson | 222/255 X |
| 3,738,400 | 6/1973 | Weil et al. | 222/309 X |
| 3,795,352 | 3/1974 | Lewis | 222/255 |
| 3,863,805 | 2/1975 | Dzaack et al. | 222/309 X |
| 4,076,482 | 2/1978 | Whetstone | 222/255 X |
| 4,120,202 | 10/1978 | Range et al. | 222/309 X |
| 4,172,669 | 10/1979 | Edelbach | 222/333 X |
| 4,207,929 | 6/1980 | Stoner | 222/137 X |
| 4,269,327 | 5/1981 | Welch | 222/309 X |

*Primary Examiner*—Charles A. Marmor

*Attorney, Agent, or Firm*—Rogers, Bereskin & Parr

[57] ABSTRACT

A metering pump is disclosed and includes a unitary pumping assembly secured to a base so as to be removable from the base as a unit e.g. for cleaning. The pump is of the plunger type and includes at least one plunger mounted to reciprocate in a pump cylinder, and a rotary valve for controlling flow of liquid into and out of the cylinder under the effect of reciprocation of the plunger. A linear actuator and a rotary actuator are each permanently mounted on the base for actuating respectively the plunger and the rotary valve. The linear actuator can be coupled to the plunger by disengageable coupling means including interfitting but physically unconnected male and female formations. The rotary actuator is similarly disengageably coupled to the valve member by a key and slot coupling. The disengageable coupling means allow the pumping assembly to be removed as a unit from the base by simply releasing a securing screw or the like.

11 Claims, 5 Drawing Figures

METERING PUMP

This invention relates generally to plunger-type metering pumps for liquids.

Typically, a pump of this type is used to dispense or meter measured volumes of liquids such as pharmaceutical preparations, perfumes, food products and the like. An example of an application of this type of pump is in a production line in which measured "shots" of liquid are required to be dispensed into rows of bottles or other containers travelling along the production line. In an application such as this, a multiple plunger pump is normally used. The plungers are arranged to reciprocate in unison in individual cylinders, each having an associated outlet nozzle through which liquid is dispensed from the cylinder. Liquid is supplied to all of the cylinders from a common inlet and a common rotary valve controls flow of liquid into the cylinders from the inlet and from the cylinders to the individual dispensing nozzles.

Conventionally, the reciprocatory movement of the plungers is derived from a common drive source such as a crankshaft which is permanently coupled to the plungers by a suitable linkage, often including a universal joint arrangement. The rotary valve may also be driven from the same source, for example, by a linkage permanently coupled to a driven rotary flange on the valve member of the rotary valve.

A problem with conventional metering pumps is that they are difficult to clean. Where the liquid being pumped is, for example, a food product or a liquid having a tendency to crystalize, frequent cleaning is normally required and in some cases it may even be necessary to clean the pump on a daily basis. In a conventional pump, this involves virtual disassembly of the pump. The driving linkages for the plungers and the rotary valve must be disconnected and at least the plungers and valve member removed for cleaning. The time required to disassemble the pump, clean the compartments, and re-assemble the pump is often substantial and results in loss of production time.

An object of the present invention is to provide an improved metering pump designed to facilitate disassembly for cleaning.

The pump provided by the invention includes a unitary pumping assembly, a base supporting the pumping assembly in an operative position and means removably securing the pumping assembly to the base. The pumping assembly includes at least one pump cylinder having a plunger mounted to reciprocate therein along an axis, the plunger extending outwardly from one end of the cylinder and the cylinder having an opening at its opposite end through which liquid can be drawn into and dispensed from the cylinder upon reciprocation of the plunger. A housing is disposed at the said opposite end of the cylinder and has an internal valve chamber communicating with the cylinder opening. A rotary valve member is mounted to turn in the chamber about a further axis between first and second positions. The pumping assembly also includes a dispensing nozzle associated with the cylinder and communicating with the valve chamber and a liquid inlet which also communicates with the valve chamber. The rotary valve member is adapted to alternately allow communication between the cylinder and the liquid inlet and between the cylinder and the dispensing nozzle in moving between its first and second positions, so that liquid can alternately be drawn into the cylinder and dispensed through the nozzle by movement of the plunger. A linear actuator is permanently mounted on the base and has an output member which is linearly reciprocable generally parallel to the axis of reciprocation of the plunger when the pumping assembly is in its operative position. Means is provided disengageably coupling the output member and the plunger. The coupling means includes respective male and female formations which are shaped to interfit with one another while remaining physically unconnected, the male formation being trapped between portions of the female formation in the direction of reciprocation of the coupling means when the actuator is in operation so that the actuator can drive the plunger in both directions of reciprocation. A rotary actuator is also permanently mounted on the base and has an outlet member which is turnable about an axis parallel to the axis of the rotary valve member when the pumping assembly is in its operative position. Disengageable coupling means is also provided between the rotary actuator output member and the valve member and includes two disengageable but physically unconnected coupling formations, one of which is shaped to define a transverse slot and the other of which is received in said slot so as to permit said output member to turn the valve member between its first and second positions. By virtue of this construction, the pumping assembly can be removed as a unit from the base after releasing the securing means only.

Preferably, the pumping assembly is designed so that, after the assembly has been separated from the base, the plungers, and the valve member can be directly removed for cleaning. It will be appreciated that the pump construction provided by the invention greatly facilitates disassembly and cleaning of the pump and correspondingly reduces the "down time" of the pump.

While in some cases the pump may have a single plunger and associated cylinder, multiple plunger pumps are also contemplated within the scope of the invention. In a multiple plunger pump, the linear actuator will serve as a common drive source for all of the plungers and the coupling means will be adapted to permit disengagement of all of the plungers from the actuator output member.

In order that the invention may be more clearly understood, reference will now be made to the accompanying drawings which illustrate preferred embodiments of the invention by way of example, and in which.

Figure 1:
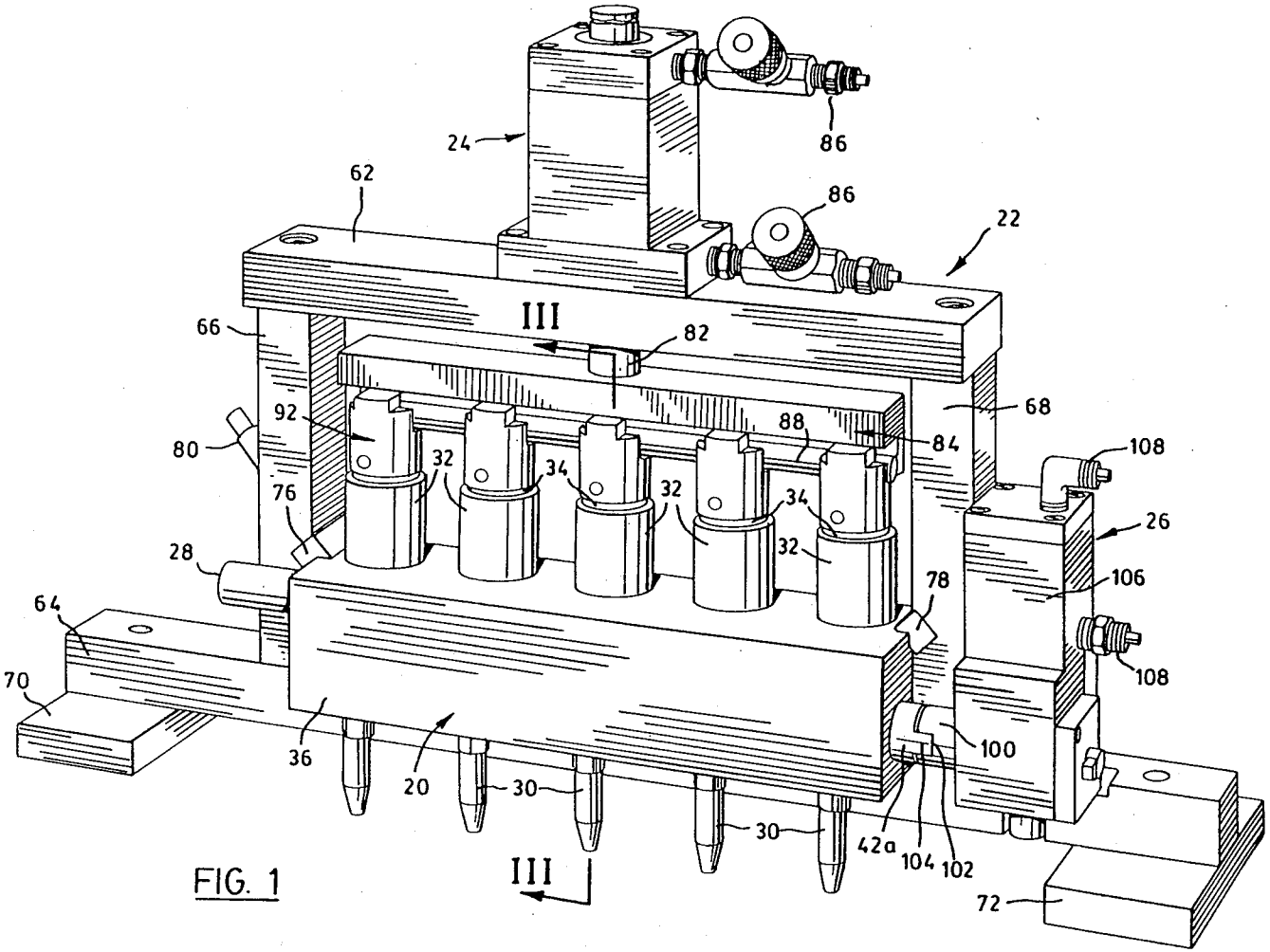
FIG. 1 is perspective view from the front and one end of a multiple plunger metering pump in accordance with one preferred embodiment of the invention.

Referring first to FIG. 1, the pump shown in that view includes a unitary pumping assembly generally denoted by reference numeral 20 removably supported in a frame 22. The pumping assembly 20 is shown removed from the frame in FIG. 2. Permanently mounted on the frame are a linear actuator 24 and a rotary actuator 26. The pumping assembly includes a tubular liquid inlet 28 and five outlet nozzles 30. Each nozzle is associated with a pump cylinder, the cylinders being denoted by reference numeral 32 in FIGS. 1 to 3. Each cylinder in turn receives a plunger designed to reciprocate in the cylinder. One of the plungers is shown at 34 in FIG. 3 but in FIGS. 1 and 2, portions only of the plungers are visible at the upper ends of the cylinders.

The linear actuator 24 is arranged to simultaneously reciprocate all of the plungers 34 in unison as will be described while the rotary actuator 26 operates a rotary valve for controlling flow of liquid into and from the cylinders under the effect of reciprocation of the plungers.

Figure 2:
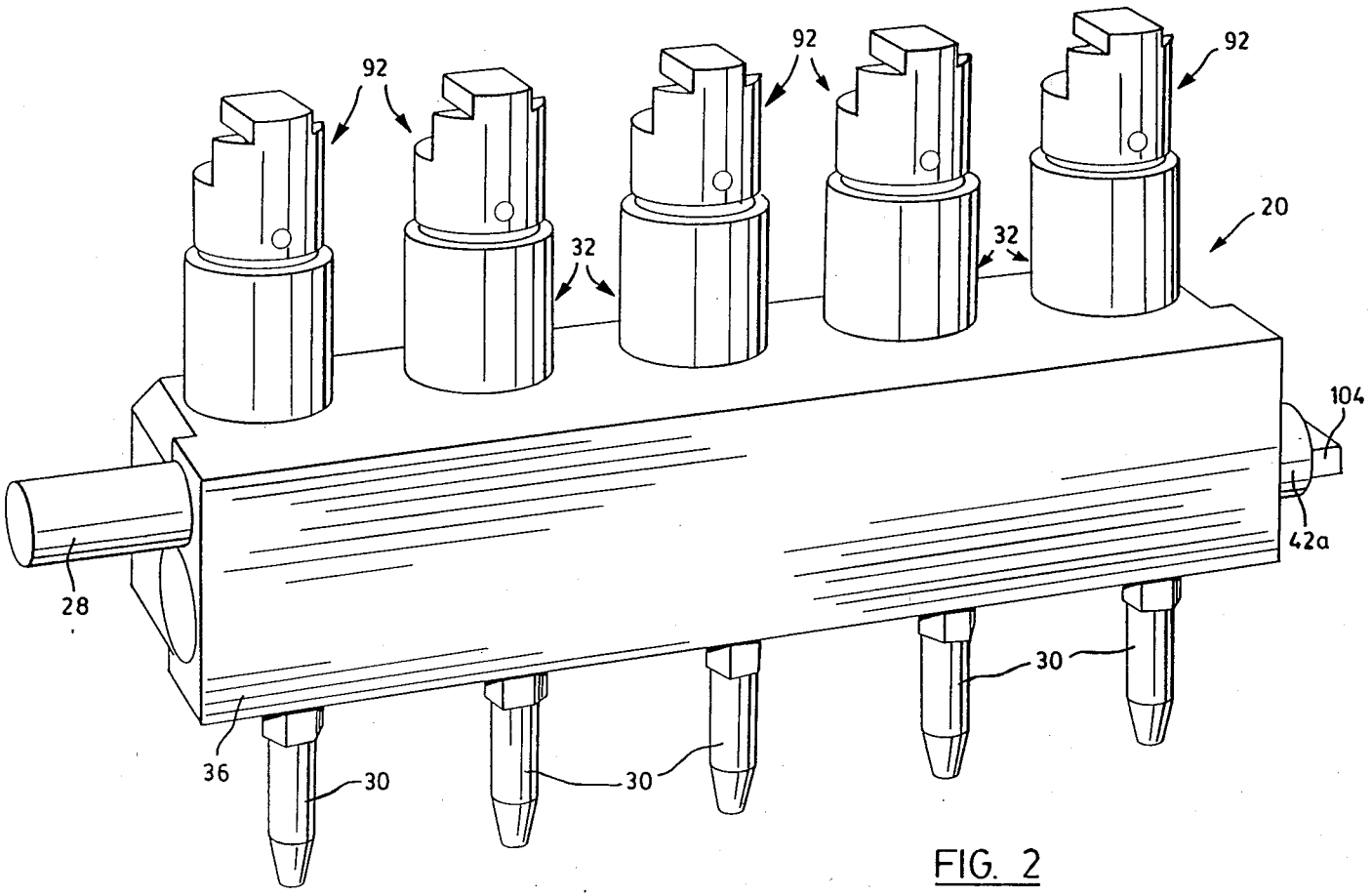
FIG. 2 is a perspective view from the front and opposite end of the pumping assembly of the pump shown in FIG. 1.
Figure 3:
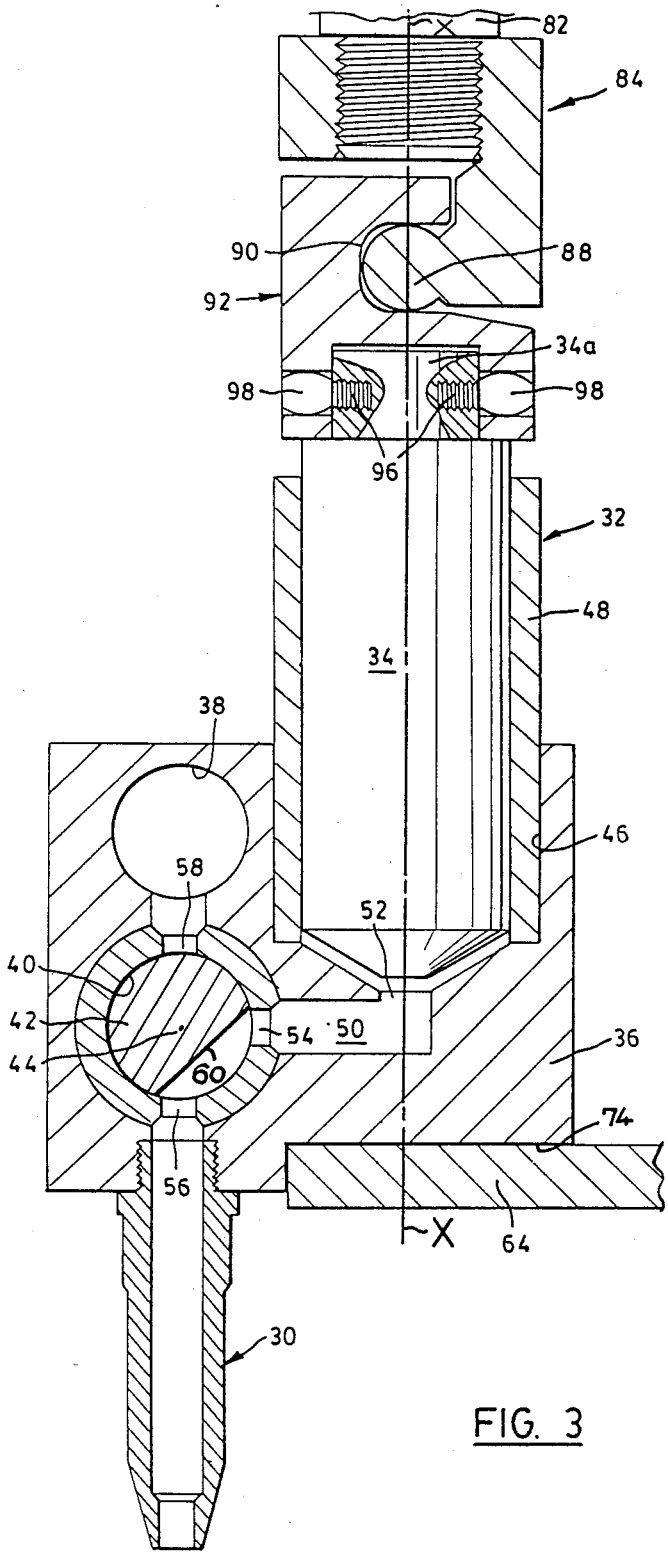
FIG. 3 is a partial vertical sectional view generally on line III—III of FIG. 1.

Referring now primarily to FIG. 3, the pumping assembly further includes a housing 36 having two longitudinally extending passageways 38 and 40 adjacent the front portion thereof as seen in FIGS. 1 and 2. The two passageways are arranged in superposed positions and the upper passageway 38 defines a liquid inlet passageway while the lower passageway 40 forms a valve chamber of the rotary valve referred to above. The liquid inlet passageway 38 communicates with the inlet 28 (FIGS. 1 and 2) at one end and is plugged at its opposite end. The valve chamber 40 receives a rotary valve member 42 which is turnable in the chamber about an axis indicated at 44 in FIG. 3. Valve member 42 protrudes from the housing at the right-hand end as seen in FIG. 1 and the passageway 40 is plugged at the opposite end of the housing. The protruding portion of valve member 42 is denoted 42*a* in FIG. 1 and is disengageably coupled with the rotary actuator 26 as will be described.

The rear portion of housing 36 is formed with a series of vertical bores 46, one for each of the cylinders 32. It will be seen that each cylinder is in fact formed by a sleeve 48 which is fitted into the associated bore 46 so as to extend upwardly from the top face of the housing. The bottom wall of the bore is of downwardly extending conical shape and communicates through an opening 52 with a passageway 50 which in turn communicates with the valve chamber 40 at an opening 54. The other cylinders are essentially the same and each communicates with a passageway similar to passageway 50; accordingly, in the illustrated embodiment there are five such passageways, opening into the valve chamber at spaced positions therealong.

As indicated previously, an outlet nozzle 30 is associated one with each of the cylinders 32. FIG. 3 shows that each nozzle is fitted into housing 36 from the underside and communicates with a vertical bore 56 which enters the valve chamber 40 in substantially the same transverse plane as passageway 50 but at a position spaced by approximately 90° from that passageway. Diametrally opposite to bore 56 is a further bore 58 which provides communication between the valve chamber and the liquid inlet passageway 38. A similar outlet nozzle and liquid inlet bore will be provided for each of the cylinders 32.

The external surface of valve member 42 is recessed as indicated at 60 in FIG. 3 to provide a valve port which in the position shown, provides communication between cylinder 32 and the outlet nozzle 30. Other similar recesses are spaced along the length of member 42 to correspond with the positions of the passageways 50 communicating with the other cylinders 32. The recesses are designed so that, by turning the valve member 42 through 90° counter-clockwise as shown in FIG. 3, each recess will provide communication between the liquid inlet passageway 38 and the interior of the relevant cylinder 32. Thus, by angularly reciprocating the valve member between these two positions, liquid can alternately be drawn into the cylinder from inlet 38 by upward movement of plunger 34, and dispensed through nozzle 30 by downward movement of the plunger. When the pump is in operation the valve member is continuously reciprocated between these two positions by the rotary actuator 26 of FIG. 1. At the same time, the plungers 34 are continuously reciprocated in unison about a generally vertical axis (denoted X—X in FIG. 3) in synchronism with the reciprocation of the valve member 42.

As indicated previously, the plungers 34 and valve member 42 are disengageably coupled with their respective actuators while remaining physically unconnected therewith, when the pumping assembly is in its operative position on the base 22 as shown in FIG. 1. At the same time, these disengageable coupling means allow the pumping assembly to be readily disengaged from the base as a unit (shown in FIG. 2) for cleaning, and then returned to the base.

Referring back to FIG. 1, base 22 comprises a frame disposed in a generally vertical plane and made up of respective upper and lower frame members 62 and 64 connected by vertical standards 66 and 68. The lower frame members have transverse "feet" 70 and 72 at their outer ends by which the pump can be mounted in its position of use, say, in a production line.

The housing 36 of the pumping assembly has the general shape of an elongate rectangular block, the lower face of which is recessed as indicated at 74 in FIG. 3 to fit onto the lower frame member 64 of the base. Abutment of the walls of this recess with member 64 properly defines the lateral position of the pumping assembly in the base. The pumping assembly is then clamped in its operative position as shown in FIG. 1 by a clamping block 76 which is accommodated by a recess formed as a partial chamfer in the left-hand end top corner of housing 36 as seen in FIG. 1. The recess extends from the rear face of the housing to a shoulder defined by the remaining corner portion of the housing and thereby provides an additional lateral restraint for the housing. A similar recess at the opposite end of the housing receives a fixed block 78 which is similar to block 76 but which is permanently secured in a V-shaped groove in the inner face of the vertical standard 68 of base 22. Clamping block 76 is carried at the outer end of a clamping screw 80 which extends obliquely downwardly through a screw-threaded bore in the other vertical standard 66. The block is coupled to the screw by a shouldered socket screw which extends upwardly from the outer face of the block and is threaded into screw 80; sufficient clearance is allowed to permit the screw to turn without the block. Thus, by turning screw 80, clamping block 76 can be moved towards or away from the housing according to the direction of turning. The oblique inclination of the surface against which block 76 is applied assists in urging the housing not only down against the lower base member 64 but also laterally against the vertical standard 68 for ensuring proper location of the pumping assembly in its operative position.

With continued reference to FIG. 1, it will be seen that the linear actuator 24 is mounted on the top frame member 62 of base 22. In this embodiment, the actuator is an air cylinder having an output member 82 which is linearly movable generally in a vertical direction as shown. The output member extends through an opening (not shown) in member 62 and is secured at its lower end to a cross-head 84 which is disengageably coupled with the plungers 34 as will be described. Fittings for coupling air hoses to the actuator 24 are shown at 86 and incorporate speed controls.

FIG. 3 best illustrates the disengageable coupling means between the linear actuator output member 82 and the plungers 34; in FIG. 3, only one plunger is of course shown but that view may be considered as representative of all cylinders.

The coupling means include respective male and female formations 88 and 90 which are shaped to interfit with one another while remaining physically unconnected with the male formation 88 trapped between portions of the female formation in the direction of reciprocation of the coupling means when the actuator is in operation. Thus, in this embodiment, the coupling means includes the cross-head 84 and it will be seen from FIG. 3 that the cross-head includes a main body portion of inverted L-shape in cross-section and a bar which is secured to the front of the depending limb of the body portion to define the male formation referred to above. The bar is provided with a flat at one side at which it is secured to the body portion.

The female formation 90 takes the form of a coupling element 92 which is generally C-shaped in cross-section as seen in FIG. 3 and which embraces the bar 88. The element is pivotally coupled to a reduced portion 34*a* at the upper end of plunger 34 and it will be seen from FIGS. 1 and 2 that each plunger is provided with a similar coupling element and that the element engage the bar 88 at spaced positions along its length. It will also be seen from those views that the coupling element is of somewhat cylindrical external shape cut away to define the recess in which the bar 88 is received. The bar should be a relatively close fit in the recess so as to avoid undue free movement between the actuator output member 82 and the plunger 34 as the plunger is reciprocated, but at the same time, the coupling elements 92 must be free to readily disengage from the bar 83 as the pumping assembly is removed from the base.

A generally cylindrical recess in the bottom of coupling element 92 defines a skirt around the reduced portion 34*a* at the top of plunger 34 and two diametrally opposed pins couple the element 92 to the plunger 34. It will be seen that each pin is threaded into the plunger and has a shank which is received in a bore in the coupling element skirt which is somewhat rounded to allow for a degree of pivotal movement of the coupling element with respect to the plunger in a plane containing the pivot axis defined by the pins 96. This allows the coupling element to self align in the event of any slight degree of misalignment between the plunger and the cross-head 84.

It will be appreciated from the foregoing, that, when the pumping assembly 20 is released from the base 22 by releasing clamp 76, the coupling elements 92 can be readily disengaged from the cross-head 84 by simply lifting away the pumping assembly. Conversely, the coupling elements can be refitted to the cross-head in reverse fashion when the pumping assembly is reinstalled.

Releasable coupling means are also provided between the rotary actuator 26 and the rotary valve member 42 as mentioned previously. FIGS. 1 and 2 show the protruding end portion 42*a* of valve member 42 and it will be seen that this portion is axially aligned with a rotary output member 100 of the rotary actuator 26. These two members define disengageable but physically unconnected coupling formations, one of which is shaped to define a transverse slot and the other of which is received in the slot so that the output member can turn the valve member between its two operative positions as described previously. In this embodiment, the output member 100 is formed with a diametral slot 102 while the portion 42*a* of the valve member has a complimentary diametral projection or key 104 which is received in the slot. Again, the formations should be a sufficiently close fit one within the other to minimize free play between the two members when the rotary actuator is operated but at the same time the formations should be readily disengageable when the pumping unit is removed from the base. At this time, the key 104 will simply slide out of the slot 102 as the pumping assembly is lifted away.

The rotary actuator 26 has not been shown in detail in the drawings since it is essentially of conventional construction. Typically, the actuator will comprise a reciprocatory air cylinder driving a rack which meshes with a pinion to which the output member 100 is coupled. Thus, as the rack reciprocates linearly, the pinion will reciprocate by corresponding angular amounts and cause the output member 100 to reciprocate. The rack and pinion are enclosed within a housing 106 which is permanently secured to the base 22. Couplings for air hoses are indicated at 108. It will of course be understood that these couplings and the couplings 86 for the linear actuator will be connected to a suitable pneumatic control system and that the two actuators will be operated in synchronism so that reciprocation of the rotary valve is properly timed in relation to reciprocation of the plungers 34 to provide the required pumping action.

Figure 4:
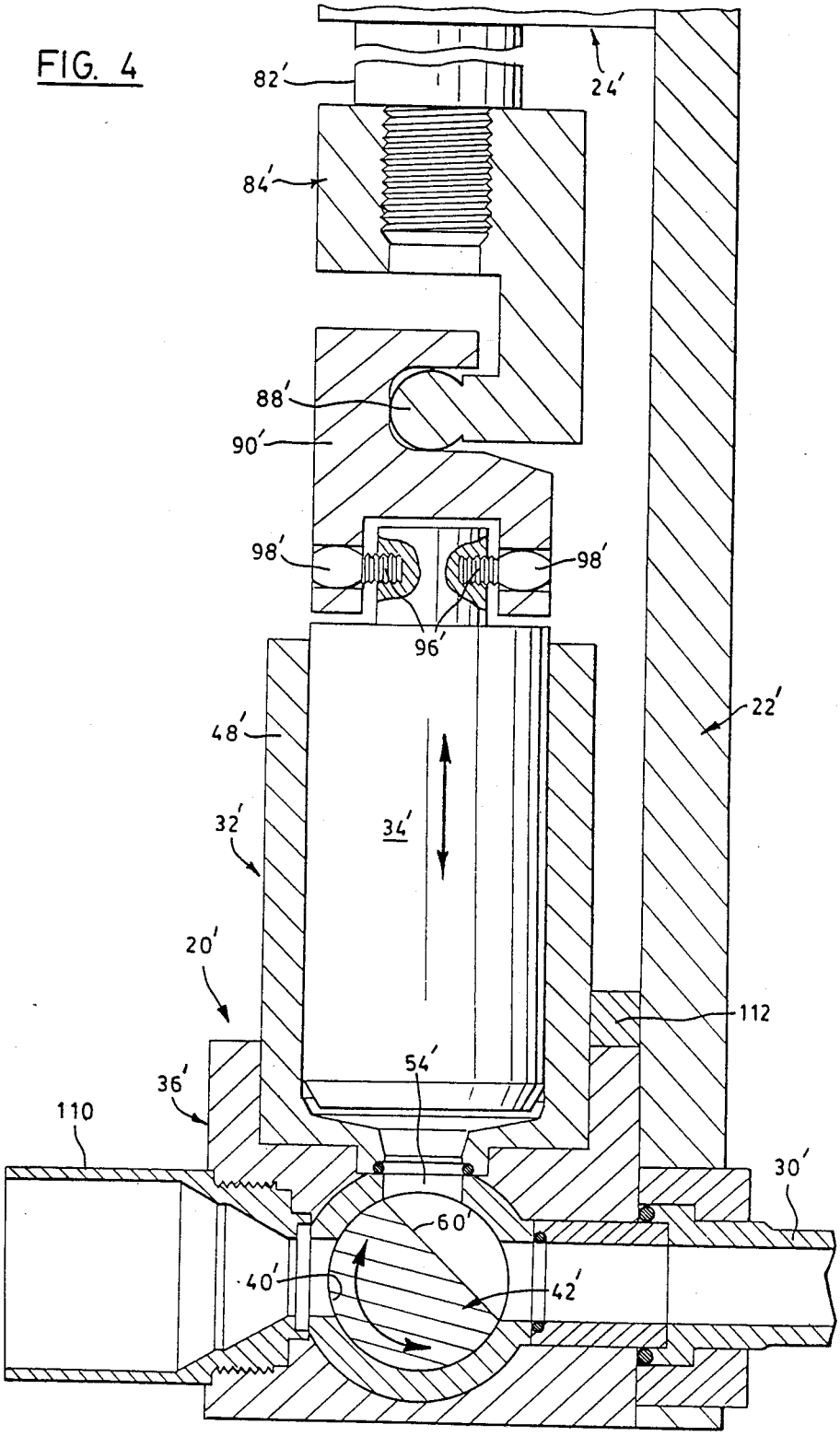
FIG. 4 is a vertical sectional view through a single plunger metering pump in accordance with a further preferred embodiment of the invention; and, FIG. 5 is a plan view corresponding to FIG. 4.
Figure 5:
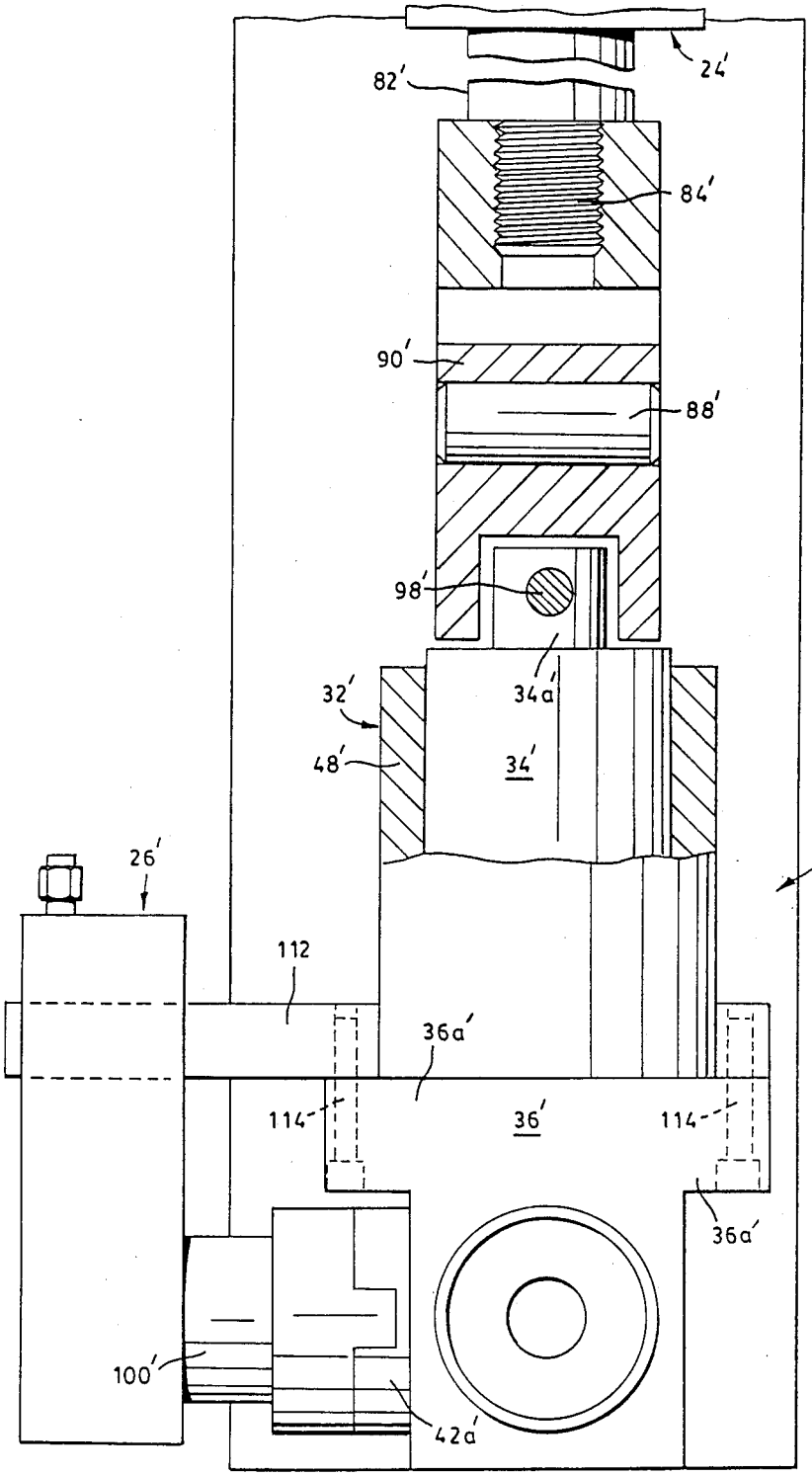

FIGS. 1 to 3 illustrate a multiple plunger type of metering pump in which the plungers are arranged to reciprocate generally vertically. FIGS. 4 and 5 on the other hand illustrate the application of the invention to a single plunger pump in which the plunger reciprocates horizontally. It will of course be understood that this type of pump could constructed as a multiple plunger pump and, conversely, that the pump shown in FIGS. 1 to 3 could be constructed as a single cylinder pump.

In FIGS. 4 and 5, parts corresponding to parts shown in FIGS. 1 to 3 have been designated by corresponding, primed reference numerals.

Referring first to FIG. 4, the plunger 34' of the pump reciprocates in a cylinder 32' formed by a sleeve 48' received in a horizontal bore in a side of a housing 36'. The bore has a central opening 54' which communicates with a valve chamber 40' in housing 36'. In contrast to the preceding embodiment, liquid is delivered to the valve chamber 40' through a liquid inlet fitting 110 which is received in a bore in housing 36' and which is positioned coaxially with the dispensing nozzle 30'. The housing also incorporates a number of minor constructional differences such as the use of ringseals and a composite dispensing nozzle assembly as compared with the one-piece assembly shown in FIG. 3; however, these features are not directly relevant to the invention and will not be described in detail.

Mounted to turn in valve chamber 40' is a valve member 42' which is essentially very similar to the valve member 42 of the preceding embodiment except in that it is of much shorter axial length and has only a single recess 60' through which liquid flows between the cylinder 32' and the inlet and outlet of the pump.

A base of the pump is shown at 22' and comprises a plate fitted with a transverse bar or block 112 which is provided at its upper side with a concave recess shaped to provide a seat for the cylinder 32'. The block also provides an abutment surface against which the housing 36' fits when the pumping assembly 20' of the pump is located in its operative position on the base.

FIG. 5 shows the shape of the housing 36' in plan and it will be noted that the housing has lateral extensions 36*a'* through which extend respective socket head cap screws 114 which are threaded in correspondingly tapped bores in the block 112. These screws constitute means for removably securing the pumping assembly to the base of the pump. By releasing these screws, it is possible to remove from the base as a unit the pumping assembly comprising the housing 36' together with liquid inlet 110 and dispensing element 30' as well as the cylinder 32' and plunger 34'.

With continued reference to FIG. 5, it will be seen that the block 112 extends laterally to one side of the cylinder 32' and supports a rotary actuator 26' which is essentially very similar to the actuator 26 of the previous embodiment. The actuator has a reciprocatory output member 100' which is disengageably coupled with a portion 42*a'* of the valve member 42 protruding from housing 36'. As in the previous embodiment, this disengageable coupling means comprises a transverse slot on one of the two members (in this case the valve member) which receives a complimentary key on the other member.

The base 22' also carries a linear actuator, part of which is visible at 24' and which is permanently secured to the base 22'. Again, that actuator has an output member 82' which is disengageably coupled with the plunger 34' by coupling means very similar to those employed in the preceding embodiment. Thus, the linear actuator output member 82' carries a fitting 84' defining a male formation 88' embraced by female formation 90' pivotally coupled to the plunger 34'. As drawn, the female formation 90' embraces the male formation 88' somewhat more snugly than in the embodiment shown in FIG. 3 but this is not a significant difference and the disengageable coupling means is essentially the same in both embodiments.

It will of course be appreciated that the preceding description relates to particular preferred embodiments of the invention and that many modifications are possible within the broad scope of the invention. Some modifications have been indicated previously and some further possible modifications are mentioned below but are not intended to limit the scope of the invention.

By way of example, in another embodiment, multiple plungers or banks of plungers could be arranged on opposite sides of a common housing and arranged to be reciprocated in opposition to one another from a single linear actuator. This would typically apply to a horizontal plunger arrangement in which the plungers or banks of plungers would extend from opposite sides of the housing and the liquid would be dispensed downwardly through nozzles depending from the housing. In this event, the coupling means between the linear actuator and the plungers might comprise cross-heads similar to the cross-head 84 of FIG. 1 associated one with each bank of plungers and coupled together so as to reciprocated together from the same linear actuator.

The form of disengageable coupling means between the linear actuator and the plungers and between the rotary actuator and the valve member may also vary. In the later case, while it is believed desirable that one of these two formations define a slot, the other formation need not be a key as such but could, for example, comprise two pins engaging in the slot. In the case of the linear actuator, the male and female coupling formations could of course be reversed. Another possibility would be to employ a ball and socket type of coupling in which the ball is located in the socket but is not captive.

The valve member and rotary actuator output member need not be directly aligned as shown in the preferred embodiment. Intermediate coupling elements may be used in some cases. Also, the rotary actuator need not reciprocate the valve member; it would be possible for the rotary actuator to intermittently turn the valve member unidirectionally between its first and second positions.

Finally, referring to the plunger or plungers of the pump it would of course be possible to employ, instead of the one-piece cylindrical plunger disclosed, a plunger comprising a piston carried by a piston rod extending from the cylinder.

I claim:

1. A metering pump comprising:

a unitary pumping assembly;

a base supporting said pumping assembly in an operative position;

means removably securing said pumping assembly to said base;

said pumping assembly comprising at least one pump cylinder having a plunger mounted to reciprocate therein along an axis, the plunger extending outwardly from one end of the cylinder and the cylinder having an opening at its opposite end through which liquid can be drawn into and dispensed from the cylinder upon reciprocation of said plunger; a housing disposed at said opposite end of the cylinder and having an internal valve chamber communicating with said cylinder opening; a rotary valve member mounted to turn in said chamber about a further axis between first and second positions; a dispensing nozzle associated with said cylinder and communicating with said valve chamber; and a liquid inlet communicating with said valve chamber; said rotary valve member being adapted to alternately allow communication between said cylinder and said liquid inlet and between said cylinder and said dispensing nozzle in moving between its first and second positions, so that liquid can alternately be drawn into the cylinder and dispensed through said nozzle by movement of said plunger;

a linear actuator permanently mounted on said base and having an output member which is linearly reciprocable generally parallel to said axis of reciprocation of the plunger when said pumping assembly is in said operative position;

means disengageably coupling said output member and said plunger, including respective male and female formations which are shaped to interfit with one another, said male formation being trapped between portions of said female formation in the direction of reciprocation of the coupling means when said actuator is in operation, whereby said actuator can drive the plunger in both directions of reciprocation;

a rotary actuator permanently mounted on said base and having an output member which is turnable about an axis parallel to said axis of the rotary valve member when said pumping assembly is in said operative position; and, means disengageably coupling said rotary actuator output member and said valve member, including two disengageable coupling formations, one of which is shaped to define a transverse slot, and the other of which is received in said slot so as to permit said output member to turn between its first and second positions;

whereby said pumping assembly can be removed as a unit from said base after releasing only said securing means;

wherein said base comprises a generally rectangular frame including a base member, an outer member generally parallel to said base member, and end members generally parallel to one another and normal to said base member and said outer member, and wherein said housing is adapted to be located on said base member between said end members when the pumping assembly is in its operative position, and wherein said means removably securing said pumping assembly to said base comprises a releasable clamp carried by one of said end frame members and adapted to bear against said housing and clamp the housing against the other of said end members.

2. A pump as claimed in claim 1, wherein said male formation of said means disengageably coupling the output member of the linear actuator and said plunger comprises a bar of generally circular shape in cross-section extending generally normal with respect to said axis of reciprocation of the plunger, and wherein said female formation is generally C-shaped in cross-section and is adapted to embrace said bar.

3. A pump as claimed in claim 1, wherein said means disengageably coupling the output member of the linear actuator and said plunger comprises coupling elements defining said male and female formations and coupled respectively to said plunger and to said linear actuator output member, the relevant one of said elements being coupled to an end portion of said plunger extending outwardly from said cylinder for pivotal movement about an axis extending generally normal to said axis of reciprocation of the plunger for accommodating possible misalingment between said axis and the axis of reciprocation of the linear actuator.

4. A pump as claimed in claim 3, wherein said coupling element defines a skirt surrounding said end portion of the plunger, and wherein said pivot axis is defined by a pair of axially aligned pivot pins extending inwardly through said skirt and secured in said plunger, portions of said pins within said skirt being rounded to define portions of reduced diameter respectively at the inner and outer surfaces of said skirt to permit additional movement of the coupling element with respect to the plunger in a plane containing said axis.

5. A pump as claimed in claim 1, which is a multiple plunger pump comprising a plurality of said pump cylinders each having a plunger mounted to reciprocate therein, wherein said housing, liquid inlet and rotary valve are common to all of said cylinders and the valve member is adapted to simultaneously control flow of liquid into and from said cylinders, and wherein said means disenageably coupling said linear actuator output member and said plungers comprises individual coupling elements carried by said plungers and a common coupling element carried by said output member and comprising a cross-head extending generally normally with respect to the axis of reciprocation of said member, said cross-head defining one of said male and female formations and said individual coupling elements each defining the other of said male and female formations.

6. A pump as claimed in claim 5, wherein said valve member protrudes from an end of said housing and is axially aligned with said rotary actuator output member, said coupling formations being formed respectively on end faces of said output member and said valve member end portion.

7. A pump as claimed in claim 1, wherein said base comprises a generally rectangular frame including a base member, an outer member generally parallel to said base member, and end members generally parallel to one another and normal to said base member and said outer member, and wherein said housing is adapted to be located on said base member between said end members when the pumping assembly is in its operative position, and wherein said means removably securing said pumping assembly to said base comprises a releasable clamp carried by one of said end frame members and adapted to bear against said housing and clamp the housing against the other of said end members.

8. A pump as claimed in claim 7, wherein said linear actuator is a pneumatic cylinder mounted on said outer frame member and wherein said output member extends through an opening in said frame member generally normal to the length thereof, and wherein said rotary actuator is mounted outwardly of one of said end frame member and is coupled to said protruding end portion of the valve member.

9. A pump as claimed in claim 1, wherein said base is adapted to support said pumping assembly with said housing mounted on the base, and wherein said means removably securing the pumping assembly to the base comprise at least one releasable bolt extending through said housing and received in a screw-threaded opening in said base.

10. A pump as claimed in claim 9, wherein said pump cylinder and plunger are intended to be horizontally disposed when said pumping assembly is in its operative position, and wherein said base comprises a plate having a generally flat upper surface and a bar on said surface against which said housing is located with a portion thereof overhanging said plate and said dispensing nozzle extending downwardly from said housing externally of the plate, said bar defining a seat receiving said cylinder, and said means removably securing said pumping assembly to said base comprising bolts extending through said housing and into said bar.

11. A metering pump comprising:

a unitary pumping assembly;

a base supporting said pumping assembly in an operative position;

means removably securing said pumping assembly to said base;

said pumping assembly comprising at least one pump cylinder having a plunger mounted to reciprocate therein along an axis, the plunger extending outwardly from one end of the cylinder and the cylinder having an opening at its opposite end through which liquid can be drawn into and dispensed from the cylinder upon reciprocation of said plunger; a housing disposed at said opposite end of the cylinder and having an internal valve chamber communicating with said cylinder opening; a rotary valve member mounted to turn in said chamber about a further axis between first and second positions; a dispensing nozzle associated with said cylinder and communicating with said valve chamber; and a liquid inlet communicating with said valve chamber; said rotary valve member being adapted to alternately allow communication between said cylinder and said liquid inlet and between said cylinder and said dispensing nozzle in moving between its first and second positions, so that liquid can alternately be drawn into the cylinder and dispensed through said nozzle by movement of said plunger;

a linear actuator permanently mounted on said base and having an output member which is linearly reciprocable generally parallel to said axis of reciprocation of the plunger when said pumping assembly is in said operative position;

means disengageably coupling said output member and said plunger, including respective male and female formations which are shaped to interfit with one another, said male formation being trapped between portions of said female formation in the direction of reciprocation of the coupling means when said actuator is in operation, whereby said actuator can drive the plunger in both directions of reciprocation;

a rotary actuator permanently mounted on said base and having an output member which is turnable about an axis parallel to said axis of the rotary valve member when said pumping assembly is in said operative position; and, means disengageably coupling said rotary actuator output member and said valve member, including two disengageable coupling formations, one of which is shaped to define a transverse slot, and the other of which is received in said slot so as to permit said output member to turn between its first and second positions;

whereby said pumping assembly can be removed as a unit from said base after releasing only said securing means;

wherein said means disengageably coupling the output member of the linear actuator and said plunger comprises coupling elements defining said male and female formations and coupled respectively to said plunger and to said linear actuator output member, the relevant one of said elements being coupled to an end portion of said plunger extending outwardly from said cylinder for pivotal movement about an axis extending generally normal to said axis of reciprocation of the plunger for accommodating possible misalignment between said axis and the axis of reciprocation of the linear actuator, said element coupled to the plunger defining a skirt surrounding said end portion of the plunger, and said pivot axis being defined by a pair of axially aligned pivot pins extending inwardly through said skirt and secured in said plunger, portions of said pins within said skirt being rounded to define portions of reduced diameter respectively at the inner and outer surfaces of said skirt to permit additional movement of the coupling element with respect to the plunger in a plane containing said axis.

* * * * *